United States Patent [19]

Shinoda

[11] Patent Number: 4,580,515

[45] Date of Patent: Apr. 8, 1986

[54] MULTIPLE NEEDLE SEWING MACHINE

[75] Inventor: Hiroshi Shinoda, Toyota, Japan

[73] Assignee: Aisin Seiki Kabushiki Kaisha, Kariya, Japan

[21] Appl. No.: 715,226

[22] Filed: Mar. 22, 1985

[30] Foreign Application Priority Data

Mar. 22, 1984 [JP] Japan ..... 59-41254

[51] Int. Cl.[4] ..... D05B 55/16; D05B 55/10

[52] U.S. Cl. ..... 112/163; 112/221

[58] Field of Search ..... 112/163, 164, 165, 166, 112/167, 221, 98, 452

[56] References Cited

U.S. PATENT DOCUMENTS 4,473,018 9/1984 Shinoda et al. ..... 112/163

4,474,124 10/1984 Yamazawa ..... 112/221 X

*Primary Examiner*—Peter Nerbun

*Attorney, Agent, or Firm*—Sughrue, Mion, Zinn, Macpeak and Seas

[57] ABSTRACT

A multiple needle sewing machine is provided with two needles which are mounted for vertical reciprocating movement in a block which may be laterally shifted between a first position and an second position wherein the first and second needles will be selectively engaged with a vertically reciprocating drive member. A first solenoid is energized to lower a needle bar holding member which is engaged with the inoperative needle to lower the inoperative needle to a position corresponding to the operative needle prior to the lateral shifting of the needles by means of a second solenoid. Subsequent to the lateral shifting of the needle bars to engage the vertical reciprocating member with the previously inoperative needle bar, the previously operative bar will be raised upwardly by the needle bar holding device upon deenergization of the solenoid by a suitable spring.

1 Claim, 8 Drawing Figures

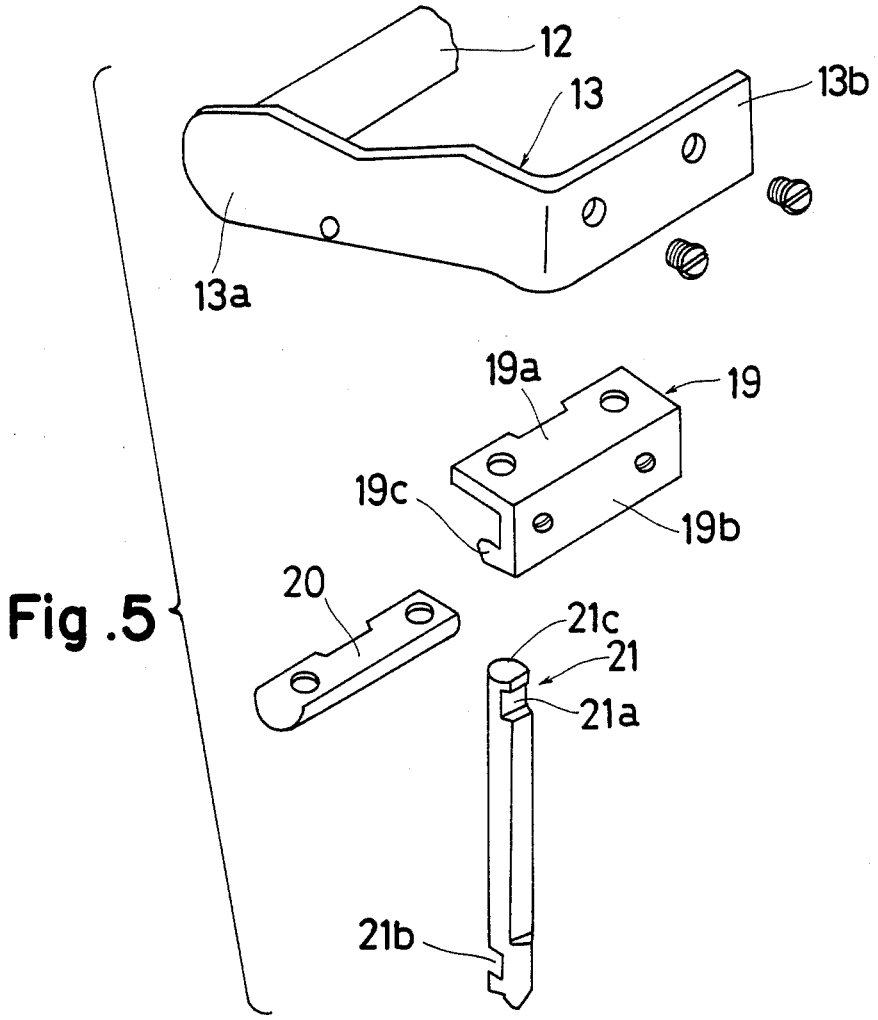
Fig .5
Fig. 6
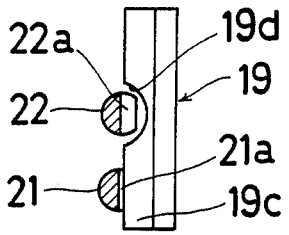

MULTIPLE NEEDLE SEWING MACHINE

BACKGROUND OF THE INVENTION

The present invention is directed to a multiple needle sewing machine or an embroidering machine, and more specifically to the needle selection means associated with the multiple needles.

In a conventional multiple needle sewing machine such as that disclosed in U.S. Pat. No. 4,474,124, granted to Masayuki Yamazawa on Oct. 2, 1984, a lever device may be located at any one of a plurality of positions corresponding to that of a specific needle bar in order to act as the needle bar changing means. However, the transfer of the lever from one position to another is a relatively cumbersome operation and can not satisfy the requirement for a quick needle bar changing operation.

SUMMARY OF THE INVENTION

The present invention provides a new and improved multiple needle sewing machine which is relatively quick and easy to operate without the aformentioned drawbacks. The needle bar changing operation is performed by a single quick action.

The present invention is directed to a new and improved multiple needle sewing machine having an overhanging arm, a first shaft rotatably mounted in said arm, a first lever fixedly connected at one end portion thereof to one end portion of said first shaft, spring means for rotating said first shaft and the other end portion of said lever in an upward direction, first and second needle bars each having thereon a middle notch and an upper notch adjacent the upper end thereof, first solenoid means operatively connected to said first lever, an adjusting member connected to the other end portion of said first lever and having an upper portion and a lower portion, said lower portion of said adjusting member being disposed in engagement with said upper notch of said first lever bar at a height above the upper dead point thereof, said upper portion of said adjusting member being urged in the downward direction for aligning an upper end portion of said needle bar with that of said second needle bar upon downward movement of said first lever upon energization of said first solenoid means, a sliding member moveable in the vertical direction by a crank means and engaged in said middle notch of said second needle bar, a common block member in which said first and second needle bars are moveably mounted in the vertical direction, said block member being moveable across the feeding line of the workpiece to be sewn, while said upper portion of said first needle bar is in alignment with that of said second needle bar, a second shaft fixedly connected at one end portion to said block member and moveable with said block members so as to disengage said sliding member from said middle notch of said second needle bar, engage said sliding member with said middle notch of said first needle bar, disengage said lower portion of said adjusting member from said upper notch of said first needle bar and engage said lower portion of said adjusting member with said upper notch of said second needle bar, a third shaft rotatably mounted in said arm, a second lever fixedly connected at a base portion thereof to one end portion of said third shaft, said second lever being connected at a distal end portion thereof to the other end portion of said second shaft, second solenoid means operatively connected to said second lever, said second solenoid means being energized at a predetermined time $t_1$ after the energization of said first solenoid means and being deenergized after a predetermined time $t_2$ subsequent to the deenergization of said first solenoid means, said predetermined time $t_1$ being sufficient to allow alignment of said upper end portion of said first needle bar with the upper end portion of said second needle bar, said predetermined time $t_2$ being sufficient to allow movement of said block member and said needle bar upwardly above the upper dead point simultaneously with the upward rotation of said adjusting member, said first lever and first shaft, a first locking member having a cavity therein and being fixedly mounted on the other end portion of said first shaft, a second locking member having a first projection fitted in said cavity of said first locking member and a second projection fixedly mounted on the other end portion of said third shaft, said locking member being swung upon rotation of said third shaft while said block member is being moved and said first locking member is being separated from said second locking member as a consequence of downward rotation of said first shaft, said second projection of said second locking member being brought into engagement with said cavity of said first locking member as a consequence of upward movement of said first shaft after deenergization of said first solenoid means and completion of the swinging movement of said second locking member due to energization of said second solenoid means, and a control circuit for controlling said first solenoid means and said second solenoid means.

The foregoing and other objects, features, and advantages of the invention will be apparent from the following more particular description of a preferred embodiment of the invention as illustrated in the accompanying drawings.

BRIEF DESCRIPTION OF THE DRAWINGS

FIG. 5 is an exploded view of a needle bar and associated mechanisms.

FIG. 6 is a plan view illustrating the relationship between the needle bars and an adjusting member.

DETAILED DESCRIPTION OF THE INVENTION

Figure 1:
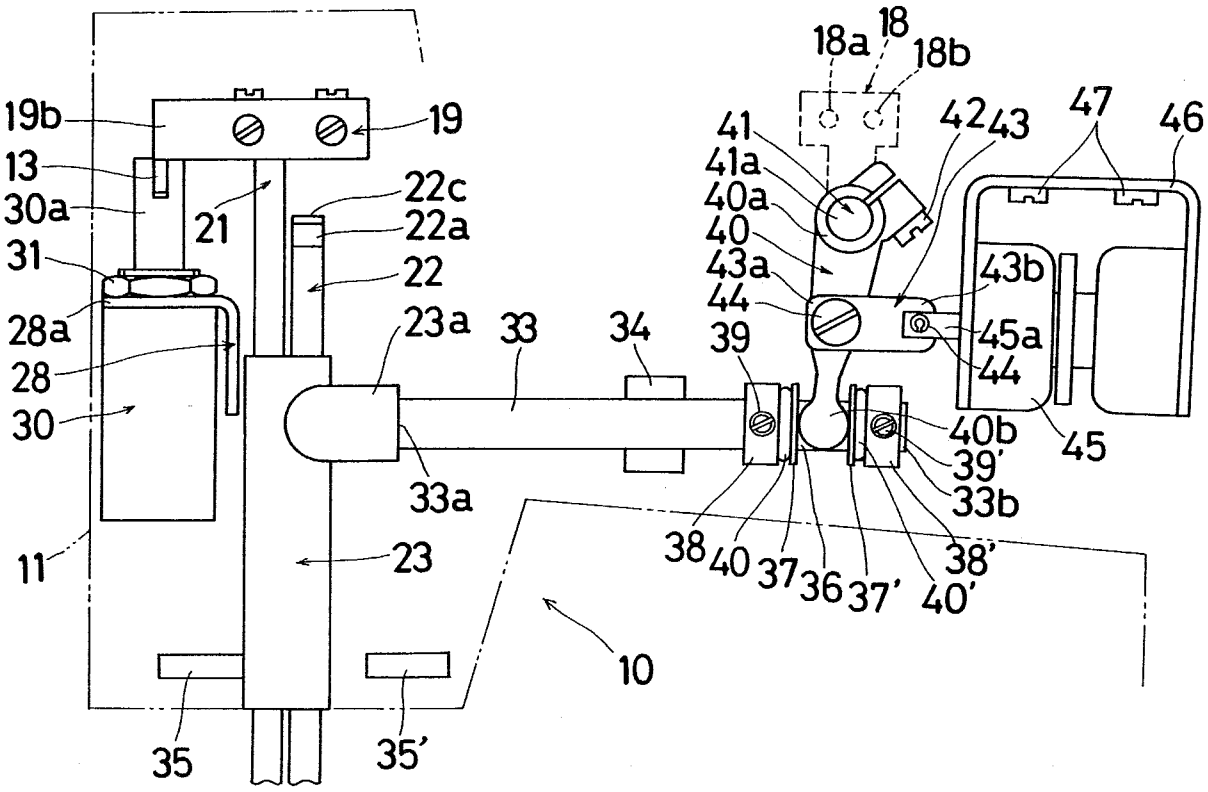
FIG. 1 is a front view of the needle bar changing mechanism for a multiple needle sewing machine.

The multiple needle sewing machine 10 according to the present invention includes an overhanging arm 11. A first shaft 12 is rotatably mounted on the rear portion of the arm 11. One end portion **12*a* of the first shaft 12 is located in the arm 11 and is connected to one end portion 13*a* of a first lever 13 by any suitable means. Thus, the other end portion 13*b* of the first lever 13 is swingable about the axis of the first shaft 12 upon rotation thereof. A torsion spring 14 is provided about the first shaft 12 with one end portion thereof connected to a collar 15 fixedly mounted on the first shaft 12 by means of a bolt 16. The other end portion of the spring 14 is disposed in engagement with an adjacent surface of the arm 11. The force of the spring 14 acts upon the first shaft 12 so that the first lever 13 is rotated upwardly in a counterclockwise direction, as viewed in FIG. 2**.

A first locking member 17 is fixedly mounted on the other end portion of the shaft 12 and terminates in an axially extending portion 17*a* having a cavity 17*b* therein. The axially extending portion 17*a* of the first locking member 17 is disposed in opposing relation to a second locking member 18 having a first projection 18*a* and a second projection 18*b*. Due to the rotation of the first shaft under the influence of the spring 14, the axially extending portion 17*a* of the first locking member 17 is brought into engagement with the second locking member 18 with the projection 18*a* disposed in the cavity 17*b*. Thus, excessive rotation of the first shaft 12 is prevented.

The other end portion 13*b* of the first lever 13 is provided with a bent portion disposed parallel to the first shaft 12 and an adjusting member 19 is fixedly mounted thereon. The adjusting member 19 is provided with an upper portion 19*a*, a side portion 19*b* adapted to be secured to the end portion 13*b* of the first lever 13, and a lower portion 19*c* having a semi-circular cutout 19*d*. An abutting member 20 is secured to the lower surface of the upper portion 19*a*, and is provided with a semi-circular cross section.

Figure 2:
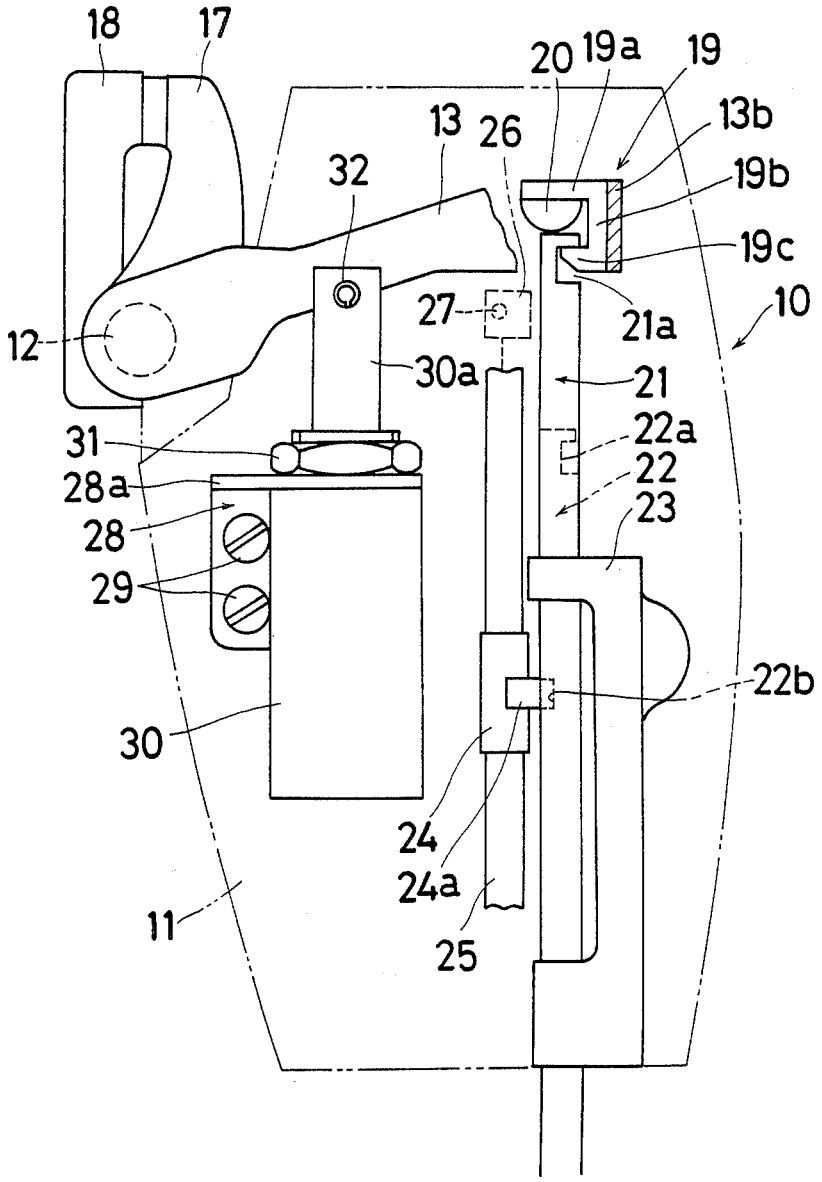
FIG. 2 is a left side view of FIG. 1.
Figure 7:
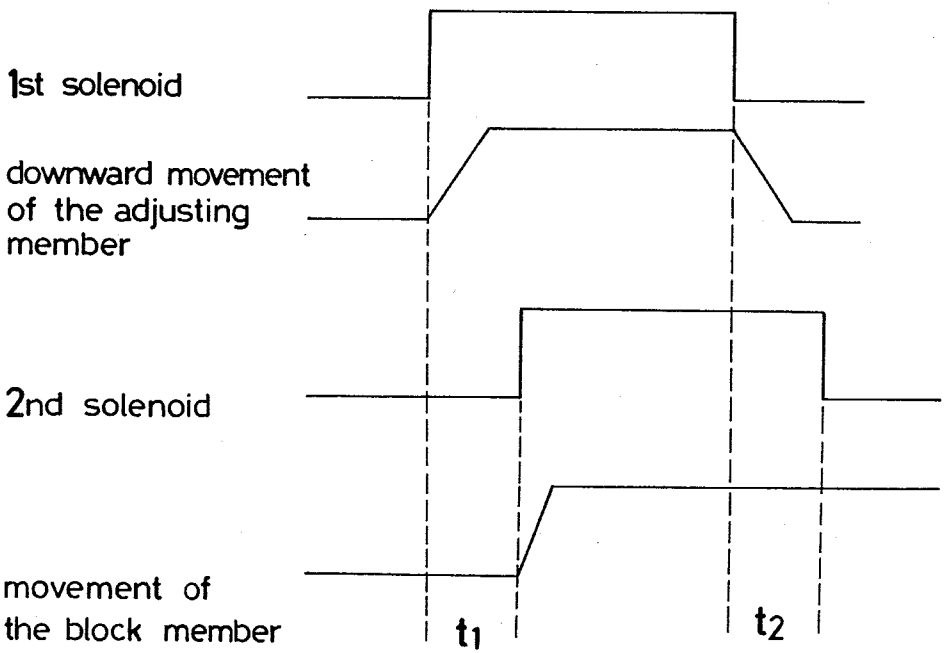
FIG. 7 is a timing chart showing the relationship of the components in a needle bar changing operation.
Figure 3:
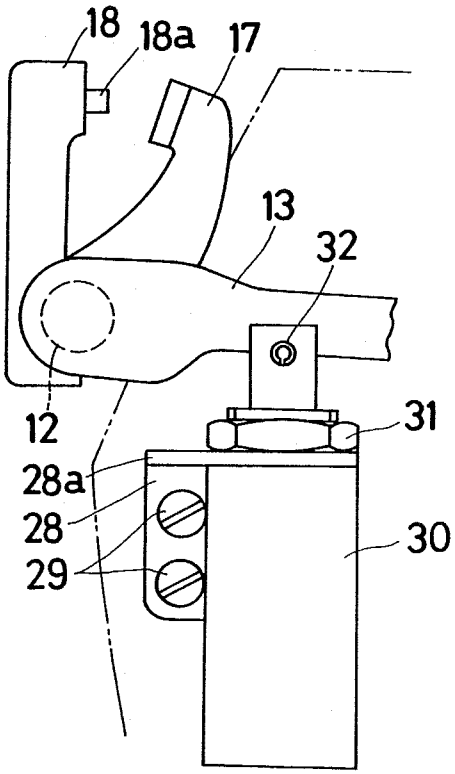
FIG. 3 is a view of the locking mechanism for preventing an unexpected needle bar changing operation.
Figure 4:
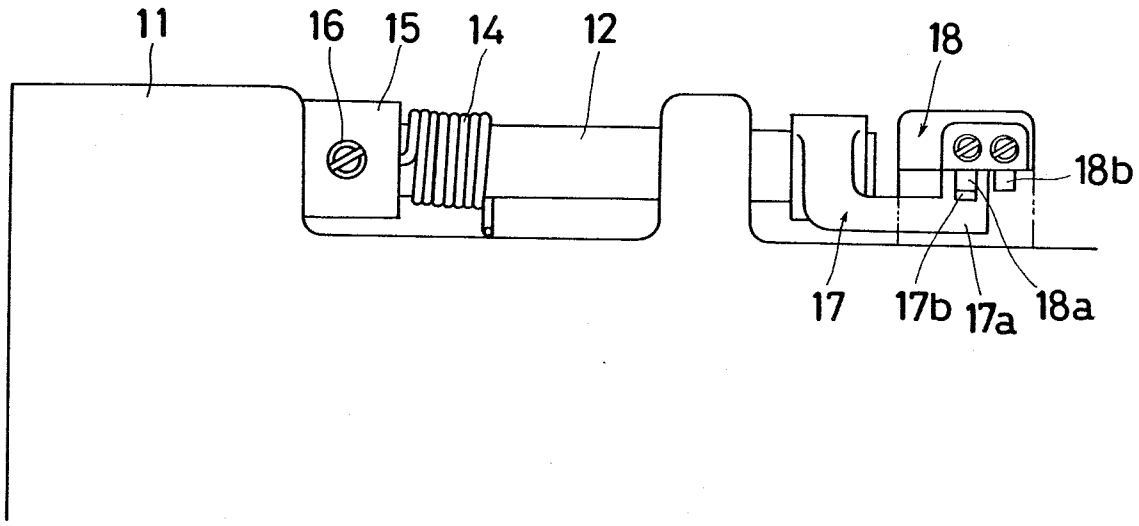
FIG. 4 is a plan view of the rear portion of the arm of a multiple needle sewing machine.

A first needle bar 21 and a second needle bar 22 are arranged for vertical reciprocating movement in a common block member 23. The first needle bar 21 is formed at the upper end thereof with an upper notch 21*a* and a middle notch 21*b* is located adjacent the middle portion of the needle bar. Similarly, the second needle bar 22 is also provided with an upper notch 22*a* and a middle notch 22*b*. As shown in FIGS. 1 and 2, the upper notch 21*a* of the first needle bar 21 is disposed in engagement with the lower portion 19*c* of the adjusting member 19 at a position above the upper dead center point of the first needle bar 21 and the middle notch 22*b* of the second needle bar 22 is disposed in engagement with a projection 24*a* on the vertically reciprocable memeber 24 which is moveable along a guide member 25. The slide member 24 is operatively connected to a crank mechanism 26 driven by the main shaft 27. Thus, the sliding member 24 is reciprocated in the vertical direction together with the second needle bar 22 during the operation of the sewing machine.

Figure 8:
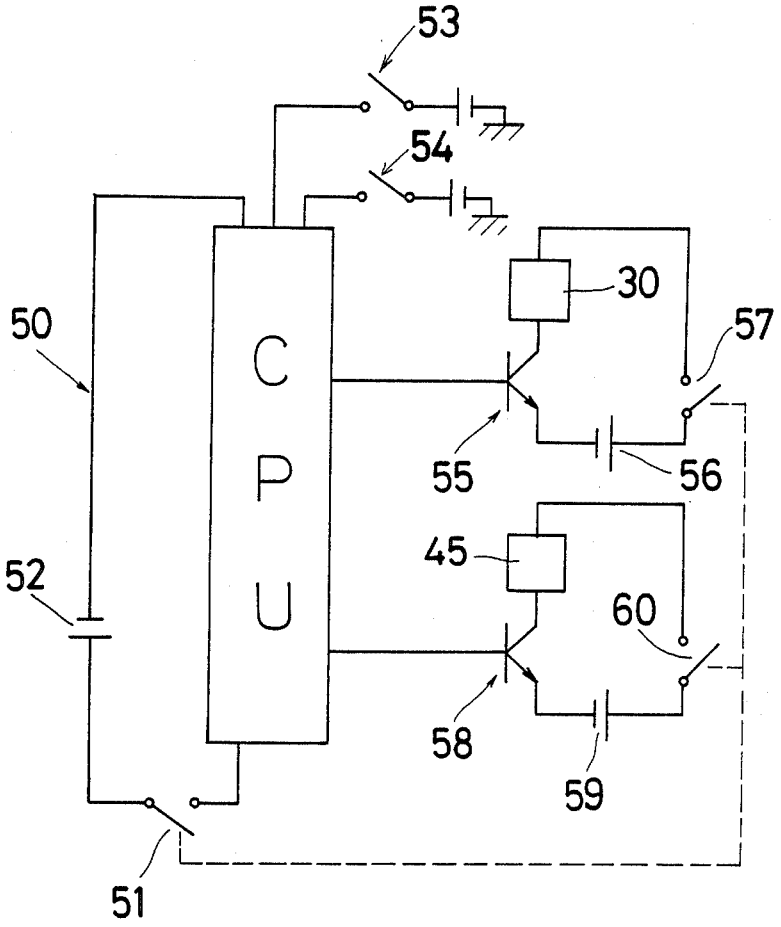
FIG. 8 is a schematic diagram of a circuit for controlling the needle bar changing operation.

A bracket 28 is secured to the arm 11 by means of bolts 29, and a first solenoid 30 is supported on a horizontal portion 28*a* of the bracket 28 by means of a nut 31. A plunger 30*a* of the first solenoid 30 is pivotally connected to the first lever 13 by means of a pin 32. The first solenoid 30 is electrically connected in the control circuit 50 of FIG. 8, which includes a first selecting switch 53. Upon closure of the switch 53, the solenoid 30 will be energized to move the plunger 30*a* in the downward direction to cause the lever 30 to move in the clockwise direction, as viewed in FIG. 2. The downward movement of the end portion 13*b* of the lever 13 causes the first needle bar 21 to move in the downward direction to bring the upper end portion 21*c* of the first needle bar 21 into alignment with the upper end portion 22*c* of the second needle bar 22.

A second shaft 33 is moveably supported on a boss 34 integrally formed within the arm 11. One end portion 33*a* of the second shaft is coupled to a boss portion 23*a* on the block member 23, which is moveable across the feeding line of the work to be sewn between a pair of horizontally spaced stops 35 and 35'. The other end portion 33*b* of the second shaft 33 is provided with an annular groove 36 between a pair of axially spaced rings or washers 37 and 37'. Collars 38 and 38' are fixedly secured to the second shaft 33 by means of bolts 39 and 39' and cushion rings 40 and 40' are disposed between the respective collars and rings.

A second lever 40 is provided with a spherical end portion 40*b* which is disposed in the groove 36. The base end portion 40*a* of the lever 40 is clamped on one end portion 41*a* of a third shaft 41 by means of a bolt 42. A rod 43 is secured to the middle portion of the second lever 40 by means of a bolt 44, and the opposite end 43*b* of the rod 43 is pivotally connected to the plunger 45*a* of a second solenoid 45. The solenoid 45 is supported on a bracket 46 secured to the inside of the arm 11 by means of bolts 47. The plunger 45*a* of the second solenoid 45 is moveable between a fully extended and a fully retracted position. transfer of the plunger 45*a* from the fully extended position to the fully retracted position, or vice versa, begins simultaneously with the energization of the second solenoid 45, a predetermined time $t_1$ subsequent to the energization of the first solenoid 30.

Upon swinging movement of the second lever 40 due to the operation of the solenoid 45, the second shaft 33 and the block member 23 are moved as a single unit in the horizontal direction.

The second locking member 18 is fixedly mounted on the opposite end portion of the third shaft 41, and is swingable upon rotation of the third shaft 41 simultaneously with the swinging movement of the second lever 40 as long as the first locking member 17 is out of engagement with the second locking member 18.

The circuit 50 includes CPU, a first switch 51, and a first power supply 52, all of which are connected in series. The CPU is also electrically connected to the first selecting switch 53, and a second selecting switch 54. The first selecting switch 53 may not be brought into the ON condition while the second selecting switch 54 is in the ON condition or the first needle bar 21 is in operative connection with the sliding member 24. The second selecting switch 54 may not be brought into the ON condition while the first selecting switch 53 is in the ON condition or the second needle bar 22 is in operative connection with the sliding member 24. The CPU is connected to the base of a first switching transistor 55. The emitter of the transistor 55, a second power supply 56, a second switch 57, the first solenoid means 30, and the collector of the transistor 55 are connected in series. Similarly, the emitter of a second switching transmitter 58, a third power supply 59, a third switch 60, the second solenoid means 45, and the collector of the transistor 58 are connected in series, and the base of the transistor 58 is connected to the CPU.

The first switch 52, the second switch 57, and the third switch 60 may be closed/opened simultaneously, and the needle bar changing operation is initiated after closure of these three switches. Upon closure of the first selecting switch 53, a signal is supplied to base of the first switching transisitor 55 thereby energizing the first solenoid means 30. After a predetermined time $t_1$ subsequent to the energization of the first solenoid 30, the second solenoid means 45 is energized. The second solenoid means is deenergized after a predetermined time $t_2$ subsequent to the deenergization of the first solenoid means 30.

In operation, upon the closure of the second selecting switch 54, the first solenoid means 30 is energized so that the plunger 30*a*, thereof, is moved downwardly to rotate the first lever 13 and the first shaft 12 in the clockwise direction, as viewed in FIG. 1. Therefore, the upper end portion 21*c* of the first needle bar is brought into correspondence with the upper portion of the second needle bar 22. The rotation of the shaft 12 will cause a first locking member 17 to be moved away from the second locking member 18 so that the first projection 18*a* will be disengaged from the cavity 17*b* of the first locking member 17. After completion of the downward movement of the first needle bar 21 and separation of the first locking member 17 from the second locking member 18, the second solenoid means 45 is energized to rotate the second lever 40 together with the third shaft 41 in the counterclockwise direction, as viewed in FIG. 1. Thus, the second shaft 33 will be moved to the right as viewed in FIG. 1, and the block member 23 will be moved in the same direction. As soon as the block member 23 is brought into engagement with the stopper 35', the first solenoid means 30 is deenergized and the first lever 13 and the adjusting member 19 are lifted or moved back to the original positions due to the spring biased movement of the first shaft 12.

Since the projection 24*a* of the sliding member 24 is brought into engagement with the middle notch 21*b* of the first needle bar 21 instead of the middle notch of the second needle bar 22, and the lower portion 19*c* of the adjusting member 19 is brought into engagement with the upper notch 22*a* of the second needle bar 22 instead of the upper notch of the first needle bar 21 during rightward movement of the block member 23, the second needle bar 22 will be moved upwardly to a position above the upper dead center point thereof due to the rotation of the first shaft 12.

The counter-clockwise rotation of the third shaft 41, as viewed in FIG. 1, will cause the second locking member 18 to also move in the counter-clockwise direction so that the second projection 18*b* of the second locking member 18 is brought into opposing relation to the cavity 17*b* before the deenergization of the first solenoid means 30. Upon deenergization of the first solenoid means 30, the cavity 17*b* of the first locking member 17 is brought into engagement with the second projection 18*b* of the second locking member 18 due to the rotation of the first shaft 12. Thus, the second needle bar 22 will be at rest and the first needle bar 21 will be ready for operation.

While the invention has been particularly shown and described with reference to a preferred embodiment thereof, it will be understood by those in the art that various changes in form and details may be made therein without departing from the spirit and scope of the invention.

What is claimed is:

1. A multiple needle sewing machine comprising an overhanging arm, a first shaft rotatably mounted in said arm, a first lever fixedly connected at one end portion thereof to one end portion of said first shaft, spring means for rotating said first shaft and the other end portion of said lever in an upward direction, first and second needle bars each having thereon a middle notch and an upper notch adjacent the upper end thereof, first solenoid means operatively connected to said first lever, an adjusting member connected to the other end portion of said first lever and having an upper portion and a lower portion, said lower portion of said adjusting member being disposed in engagement with said upper notch of said first lever bar at a height above the upper dead point thereof, said upper portion of said adjusting member being urged in the downward direction for aligning an upper end portion of said needle bar with that of said second needle bar upon downward movement of said first lever upon energization of said first solenoid means, a sliding member moveable in the vertical direction by a crank means and engaged in said middle notch of said second needle bar, a common block member in which said first and second needle bars are moveably mounted in the vertical direction, said block member being moveable across the feeding line of the workpiece to be sewn, while said upper portion of said first needle bar is in alignment with that of said second needle bar, a second shaft fixedly connected at one end portion to said block member and moveable with said block member so as to disengage said sliding member from said middle notch of said second needle bar, engage said sliding member with said middle notch of said first needle bar, disengage said lower portion of said adjusting member from said upper notch of said first needle bar and engage said lower portion of said adjusting member with said upper notch of said second needle bar, a third shaft rotatably mounted in said arm, a second lever fixedly connected at a base portion thereof to one end portion of said third shaft, said second lever being connected at a distal end portion thereof to the other end portion of said second shaft, second solenoid means operatively connected to said second lever, said second solenoid means being energized at a predetermined time $t_1$ after the energization of said first solenoid means and being deenergized after a predetermined time $t_2$ subsequent to the deenergization of said first solenoid means, said predetermined time $t_1$ being sufficient to allow alignment of said upper end portion of said first needle bar with the upper end portion of said second needle bar, said predetermined time $t_2$ being sufficient to allow movement of said block member and said needle bar upwardly above the upper dead point simultaneously with the upper rotation of said adjusting member, said first lever and first shaft, a first locking member having a cavity therein and being fixedly mounted on the other end portion of said first shaft, a second locking member having a first projection fitted in said cavity of said first locking member, and a second projection fixedly mounted on the other end portion of said third shaft, said locking member being swung upon rotation of said third shaft while said block member is being moved and said first locking member is being separated from said second locking member as a consequence of downward rotation of said first shaft, said second projection of said second locking member being brought into engagement with said cavity of said first locking member as a consequence of upward movement of said first shaft after deenergization of said first solenoid means and completion of the swinging movement of said second locking member due to energization of said second solenoid means, and a control circuit for controlling said first solenoid means and said second solenoid means.

* * * * *